US008821203B1

(12) United States Patent
Ellis

(10) Patent No.: US 8,821,203 B1
(45) Date of Patent: Sep. 2, 2014

(54) BODY SURFING HYDROFOIL AND ASSOCIATED METHODS

(76) Inventor: Dale E. Ellis, Deltona, FL (US)

( * ) Notice: Subject to any disclaimer, the term of this patent is extended or adjusted under 35 U.S.C. 154(b) by 286 days.

(21) Appl. No.: 13/328,478

(22) Filed: Dec. 16, 2011

Related U.S. Application Data

(60) Provisional application No. 61/423,879, filed on Dec. 16, 2010, provisional application No. 61/745,999, filed on Apr. 15, 2011, provisional application No. 61/486,029, filed on May 13, 2011.

(51) Int. Cl.
*B63B 35/00* (2006.01)

(52) U.S. Cl.
USPC ..... 441/65

(58) Field of Classification Search
CPC ..... B63B 35/7909; B63B 35/7906; B63B 2231/50; B63B 2035/7903; B63B 2035/79036
USPC ..... 441/55, 74, 79; 2/16, 462, 463
See application file for complete search history.

(56) References Cited

U.S. PATENT DOCUMENTS

| | | | | |
|---|---|---|---|---|
| 3,179,963 | A | | 4/1965 | Peterson |
| 3,335,441 | A | | 8/1967 | Wolfe |
| 3,400,415 | A | | 9/1968 | Scheurer |
| 3,803,652 | A | | 4/1974 | Uyehara |
| 4,263,686 | A | | 4/1981 | Jarvis, Jr. |
| 4,302,860 | A | | 12/1981 | Puch |
| 4,397,636 | A | | 8/1983 | Ganshaw |
| 4,437,842 | A | | 3/1984 | Connor |
| 4,932,911 | A | | 6/1990 | Albrecht |
| 5,013,271 | A | * | 5/1991 | Bartlett ..... 441/65 |
| 5,015,208 | A | | 5/1991 | Fox et al. |
| 5,055,075 | A | | 10/1991 | Waller, Jr. |
| 5,106,331 | A | | 4/1992 | Lizarazu |
| D329,633 | S | | 9/1992 | Rodgers, Jr. |
| 5,167,551 | A | | 12/1992 | Davis |
| 5,173,068 | A | * | 12/1992 | Dunn et al. ..... 441/65 |
| 5,183,424 | A | | 2/1993 | Field |
| 5,516,320 | A | | 5/1996 | LaPlant |
| 5,569,057 | A | | 10/1996 | Barsdorf et al. |
| 6,213,831 | B1 | | 4/2001 | Smith |
| 6,544,089 | B2 | | 4/2003 | Zapatero Denegri |
| 6,620,010 | B2 | | 9/2003 | Noonan |
| 6,986,691 | B2 | | 1/2006 | Johnson et al. |

(Continued)

FOREIGN PATENT DOCUMENTS

| | | |
|---|---|---|
| AU | 60761/96 | 7/1996 |
| FR | 2789651 A1 | 8/2000 |
| WO | 01/83292 A1 | 11/2001 |

*Primary Examiner* — Lars A Olson
*Assistant Examiner* — Anthony Wiest
(74) *Attorney, Agent, or Firm* — Courtney M. Dunn; Lowndes, Drosdick, Doster, Kantor & Reed, P.A.

(57) ABSTRACT

A body surfing hydrofoil includes a breastplate having a buoyant material extending between an inner surface and outer surface. The breastplate has a generally rigid planar shape defined by a perimeter having opposing sides diverging outwardly from a top portion to a bottom portion. A spacer is affixed to the inner surface of the breastplate and is sufficiently flexible for compressing and retracting as a result of breathing by a person biased against the spacer. A rear flotation member is integrally connected to the breastplate.

27 Claims, 16 Drawing Sheets

(56) References Cited

U.S. PATENT DOCUMENTS

| | | | | |
|---|---|---|---|---|
| 7,074,098 | B1 | 7/2006 | Acosta, Jr. | |
| 7,438,619 | B2 * | 10/2008 | Staver et al. | 441/115 |
| D607,525 | S | 1/2010 | Marciano | |
| 2006/0073943 | A1 | 4/2006 | Perka | |
| 2008/0020660 | A1 * | 1/2008 | Barney | 441/65 |
| 2008/0070458 | A1 * | 3/2008 | Crough | 441/65 |
| 2009/0156072 | A1 | 6/2009 | Sick | |
| 2011/0151733 | A1 | 6/2011 | Gadler | |

* cited by examiner

BODY SURFING HYDROFOIL AND ASSOCIATED METHODS

CROSS REFERENCE TO RELATED APPLICATION

This application claims the benefit of U.S. Provisional Application Nos. 61/423,879 having a filing date of Dec. 16, 2010; 61/475,999 having a filing date of Apr. 15, 2011; and 61/486,029 having a filing date of May 13, 2011 for Body Surfing Enhancement Device and Associated Methods, the disclosures of which are hereby incorporated by reference herein in their entirety, and all commonly owned.

FIELD OF INVENTION

The invention generally relates to aquatic sports, and more particularly to body surfing.

BACKGROUND

It is known to use surfboards to support a person while on the surface of water, commonly known as "riding" a wave. It is also known to "body surf," that is, to ride a wave without the use of a surfboard by stretching one's body out in as planar a configuration as possible and permitting oneself to be carried ashore by the wave.

As is well known in the art, body surfers typically extend their bodies horizontally and project their arms forward while allowing a breaking wave to drive them shoreward with the surf. It is important to a body surfer to have a stable ride and to be able to control direction and position on a wave face. Since a body surfer typically avoids using a surf board, it is generally difficult to control stability, direction and position on a wave face. As a result, body surfing suits are popular and well known in the art. For a body surfing suit to work as desired, the suit must allow for ease in bending ones body in all natural directions of movement while swimming and providing buoyancy in a preferred location and position with respect to the surface of the water. It is preferable to have buoyancy greatest at the surfer's chest and taper down toward the feet to ensure the surfer has a safe and enjoyable ride. It is also desirable to provide comfort during repeated and multiple rides. It is especially desirable that the surfer be allowed to breathe easily during an entire water activity involving swimming, surfing and vertical or horizontal rest periods.

While few body surfing suits are well known, typically upper body portions do not allow adequate body bending because of a rigid structure being employed and while buoyant materials are used, they are not strategically placed to provide a desirable water experience. Further, while fins are employed, they are not typically sized or positioned to provide a synergy with the upper body portion of the suit for enhancing the wave surfing experience.

The present invention seeks to overcome limitations by providing the body surfer a means to stabilize his ride and control his direction and position on a wave while being able to experience multiple events without over exertion. Further, body surfing is known to be quite difficult and demanding on one's body, especially in more rigorous wave conditions. Therefore, it would be beneficial to provide means for enhancing the body surfing experience even in such rigorous conditions.

SUMMARY OF INVENTION

The present invention is directed to a body surfing hydrofoil. In keeping with the teachings of the present invention, one embodiment may comprise a plurality of substantially rigid elements connectable together with flexible elements to form a "suit" wearable by a user.

One embodiment of the invention may include a body surfing hydrofoil comprising a breastplate having a buoyant material extending between an inner surface and outer surface, the breastplate having a planar shape defined by a perimeter having opposing sides diverging outwardly from a top portion to a bottom portion, wherein the breastplate has a generally rigid construction, a spacer affixed to the inner surface of the breastplate, wherein the spacer is sufficiently flexible for compressing and retracting as a result of breathing by a person in a prone position on the spacer, and a rear flotation member having an integrated foam bridge connection to the breastplate.

Yet another embodiment according to the teachings of the present invention may comprise a wet suit formed from a generally flexible fabric, a plurality of fixed elements secured to outside surface portions of the wet suit, a breastplate having a buoyant material extending between an inner surface and outer surface, the breastplate having a planar shape defined by a perimeter having opposing sides extending from a top portion to a bottom portion, wherein the breastplate has a generally rigid construction, a spacer affixed to the inner surface of the breastplate, wherein the spacer is sufficiently thick enough to provide a separation of the wearer's torso from the water surface when a hydrofoil effect begins. The spacer is flexible for compressing and retracting as a result of breathing by a person in a vertical position on the spacer, and non elastic elements attached between each of the plurality of rigid elements and the breastplate.

BRIEF DESCRIPTION OF DRAWINGS

Embodiments of the invention are described by way of example with reference to the accompanying drawings in which.

DETAILED DESCRIPTION OF PREFERRED EMBODIMENTS

The present invention will now be described more fully hereinafter with reference to the accompanying drawings, in which embodiments of the invention are shown by way of illustration and example. This invention may, however, be embodied in many forms and should not be construed as limited to the embodiments set forth herein. Rather, these embodiments are provided so that this disclosure will be thorough and complete, and will fully convey the scope of the invention to those skilled in the art. Like numerals refer to like elements.

Figure 1:
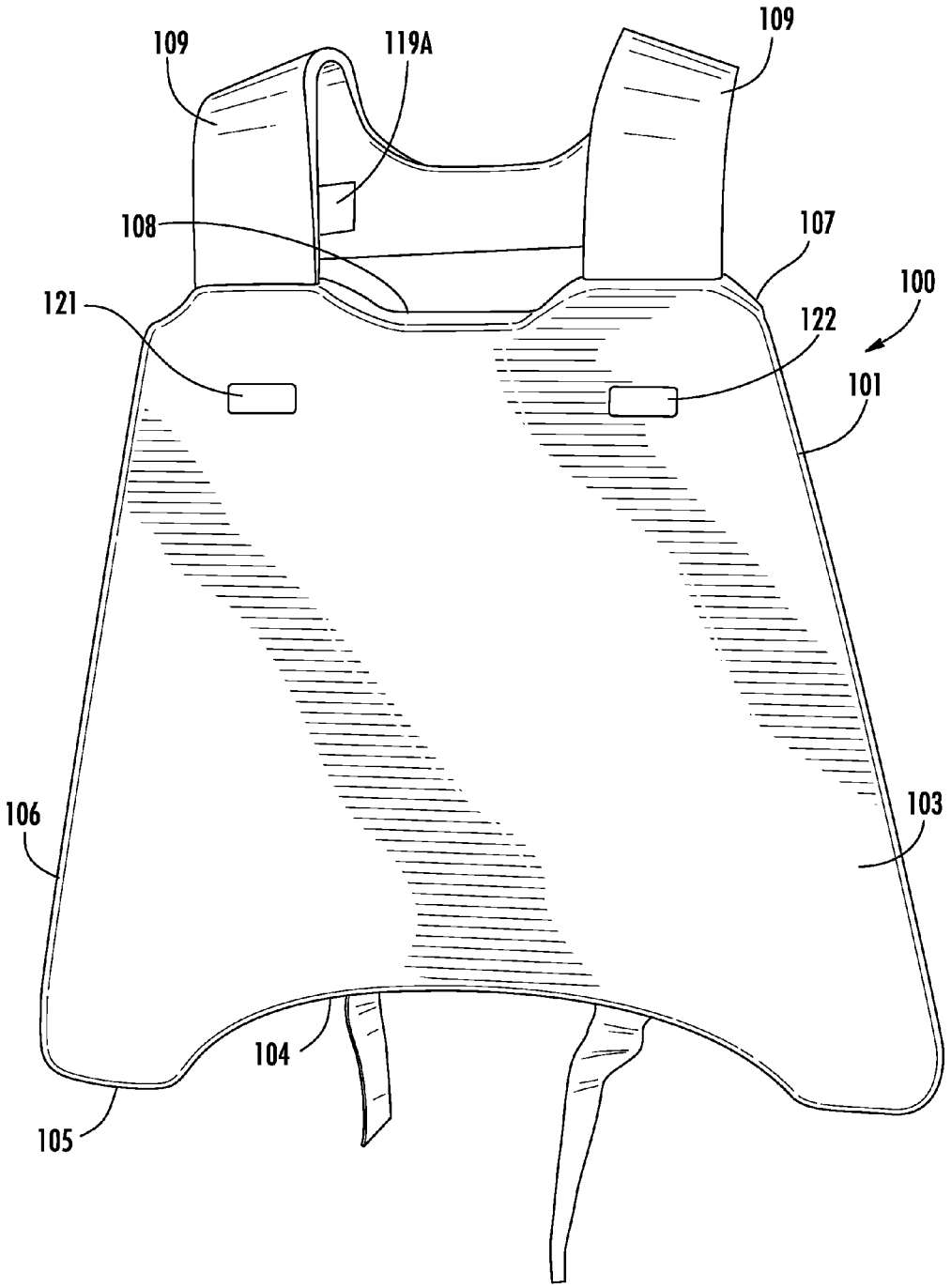
FIG. 1 is a front perspective view of an exemplary body surfing hydrofoil in keeping with the teachings of the present invention.
Figure 2:
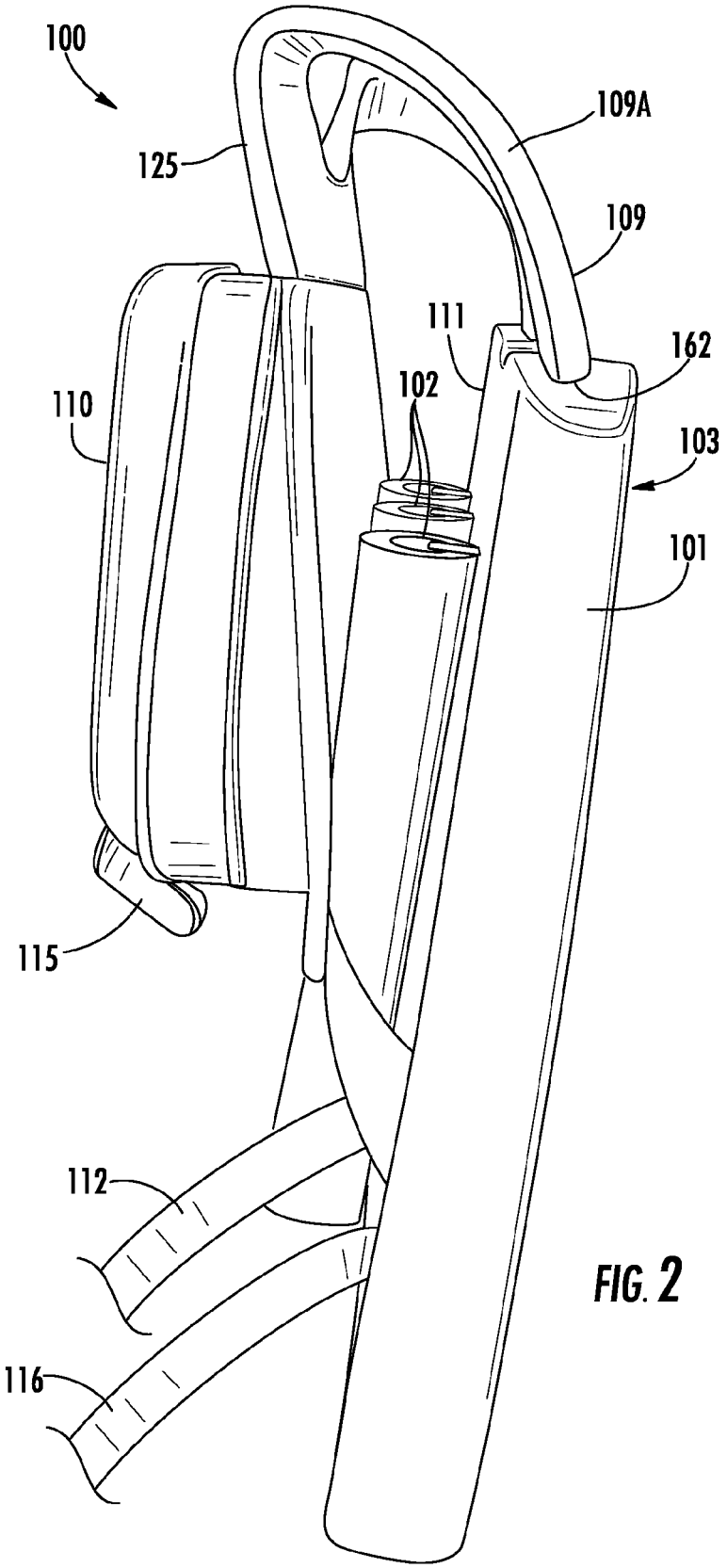
FIG. 2 is side perspective view of the embodiment of FIG. 1.
Figure 3:
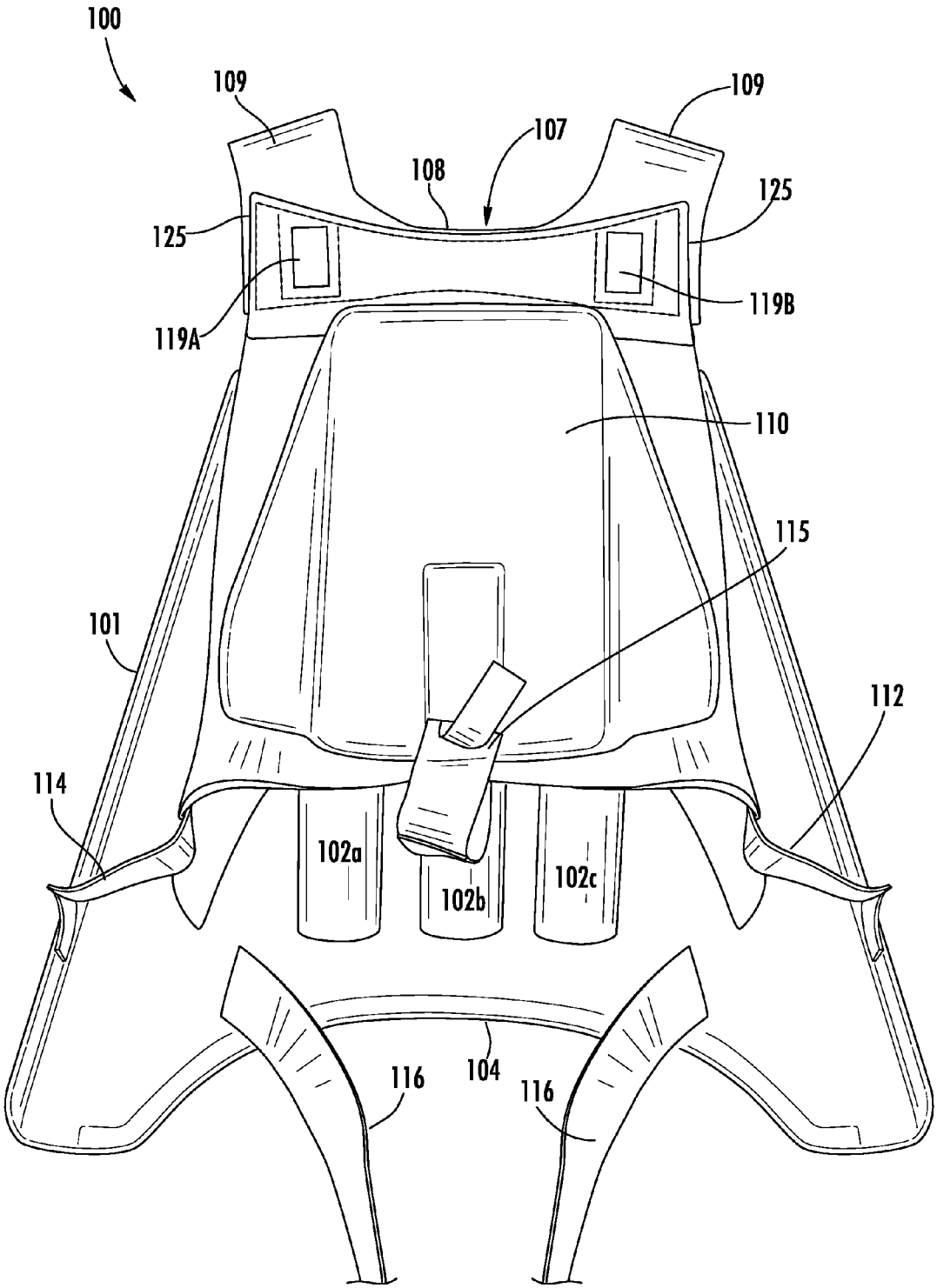
FIG. 3 is a back perspective view of the embodiment of FIG. 1.
Figure 10:
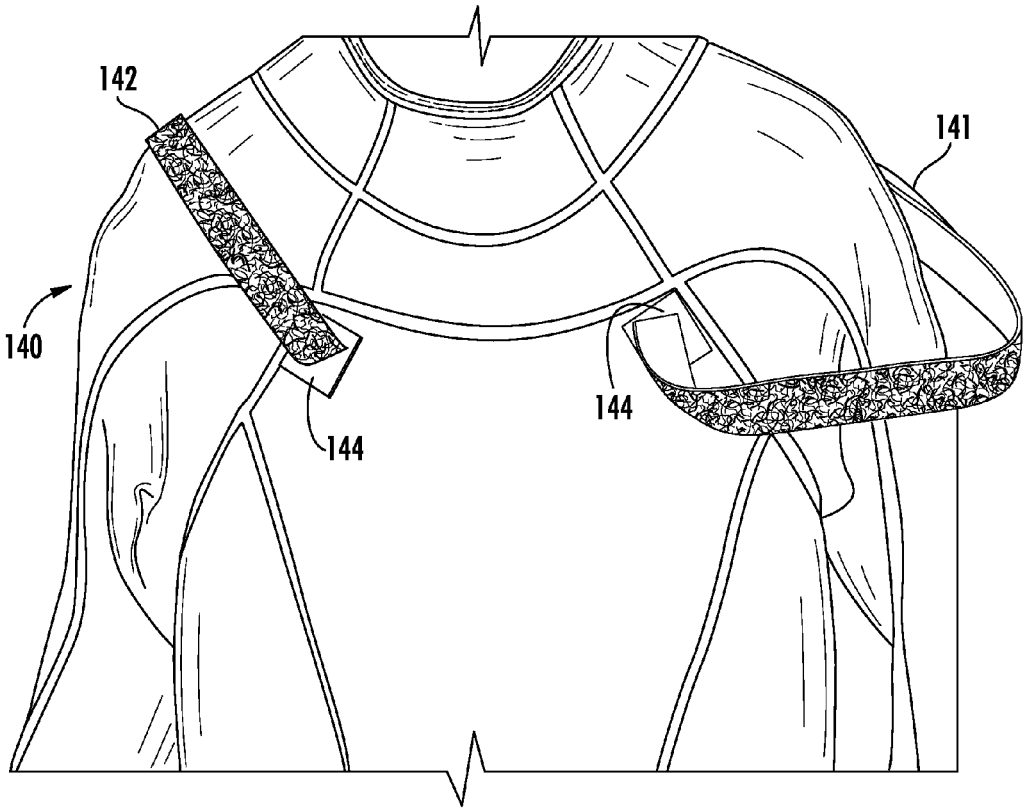
FIG. 10 is a partial front view of a wet suit's torso portion useable with the embodiment of FIG. 10.
Figure 11:
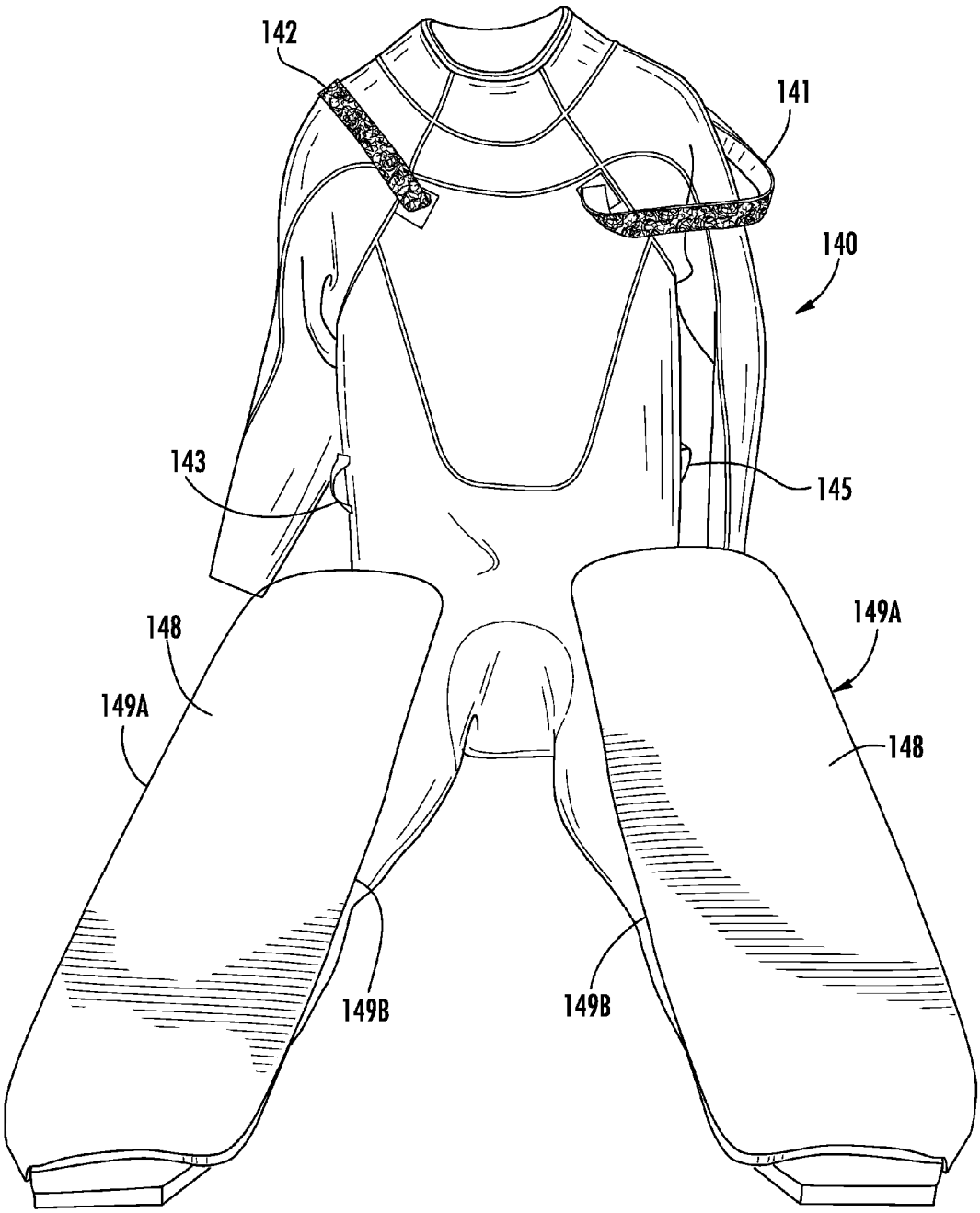
FIG. 11 is a front perspective view illustrating a full wet suit having leg wings in keeping with the teachings of the present invention.
Figure 12:
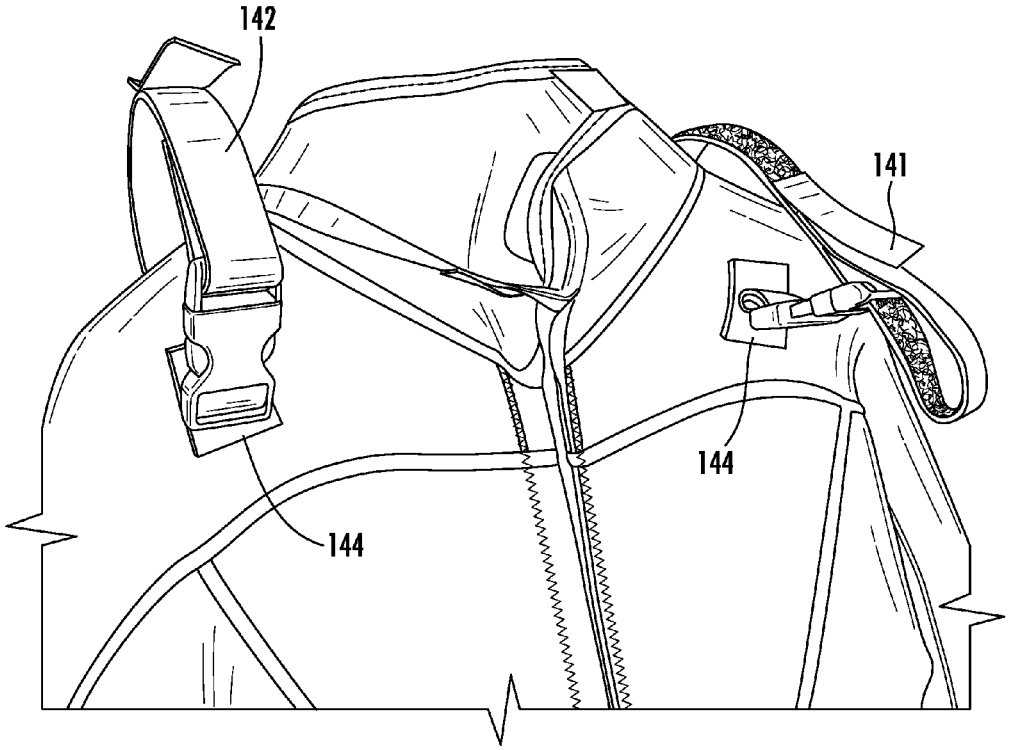
FIG. 12 is a partial rear perspective of a top portion of a wet suit useable with the embodiment of FIG. 1.
Figure 13:
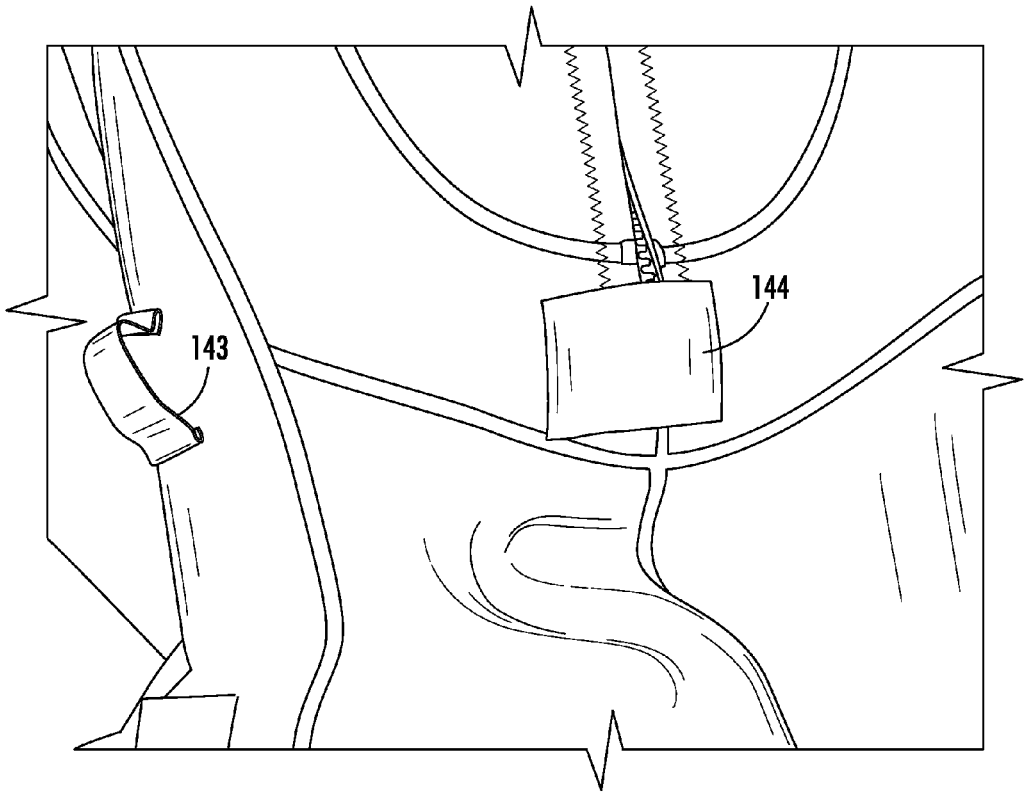
FIG. 13 illustrates rigid elements secured to an otherwise flexible fabric typically used for wet suits.
Figure 14:
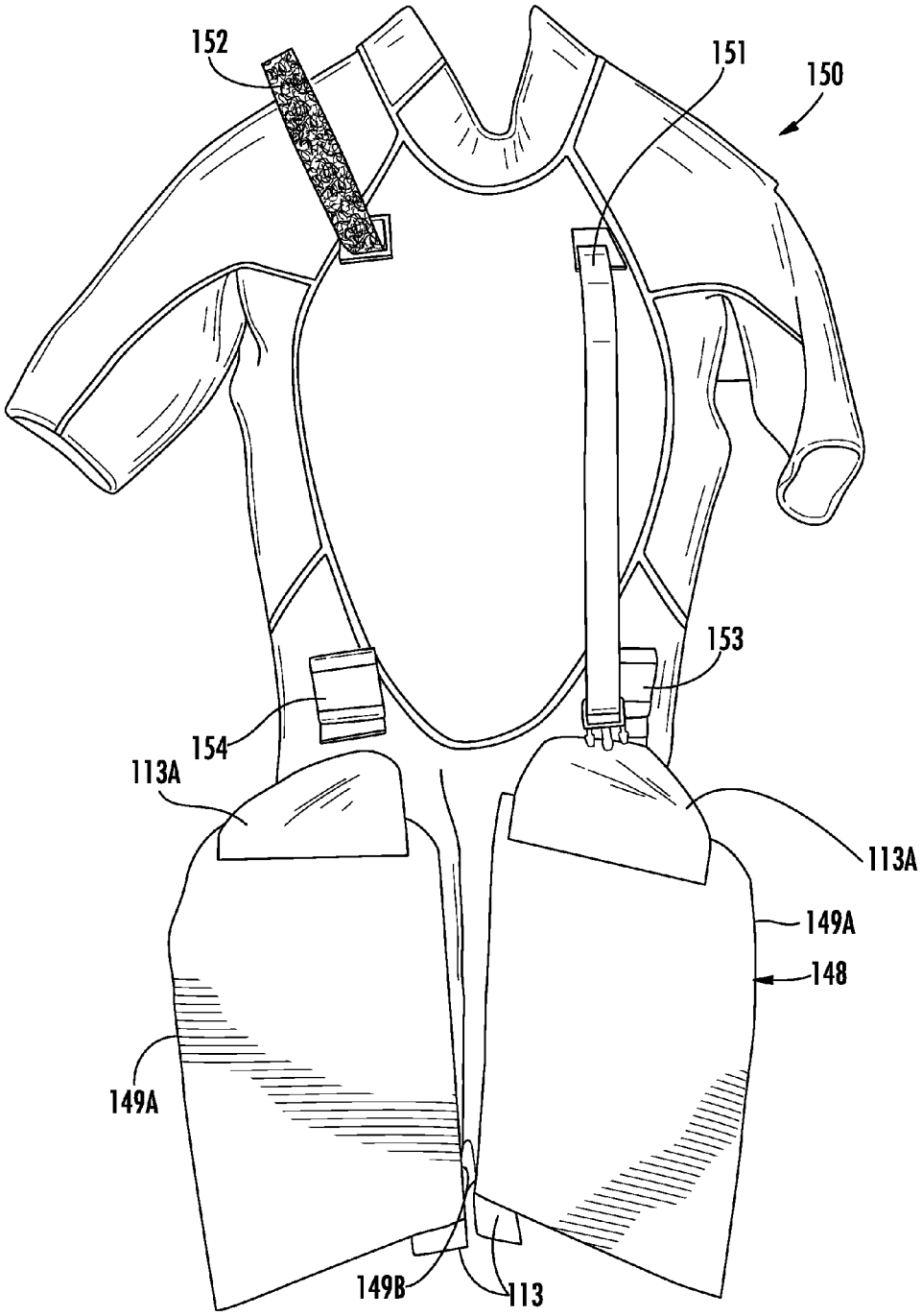
FIG. 14 is a front perspective view of the embodiment of FIG. 4 that illustrates non-elastic straps carried on a wet suit suitable for connection to the embodiment of FIG. 1.
Figure 15:
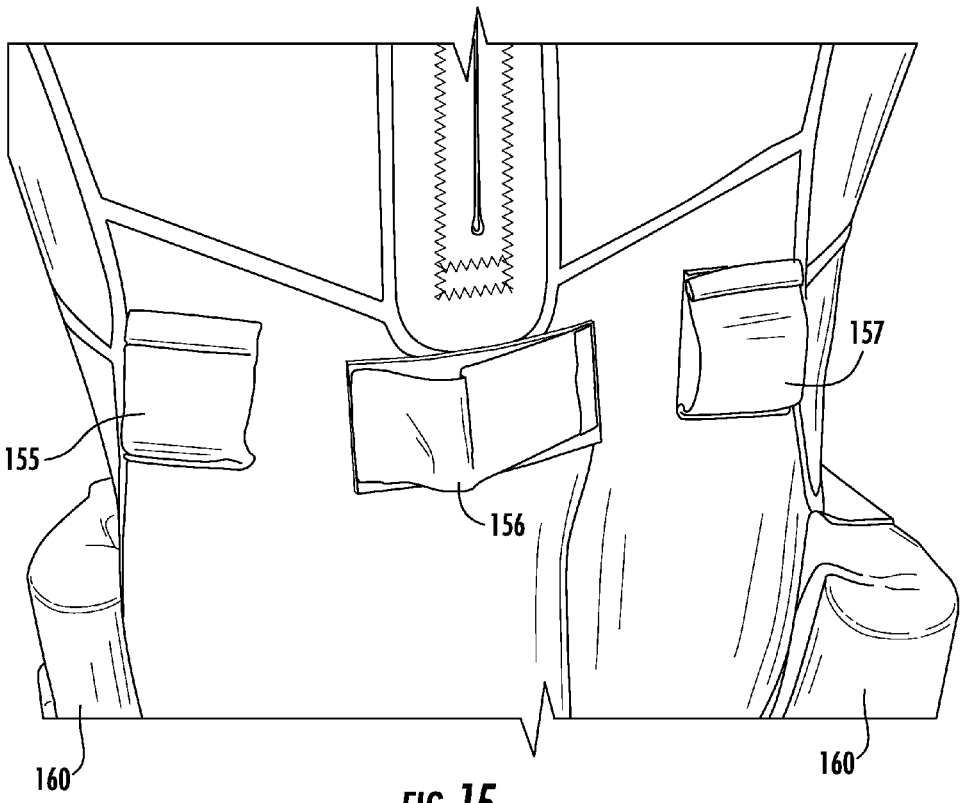
FIG. 15 is a partial rear perspective view of the embodiments of FIG. 14 that illustrates non-elastic straps carried on a wet suit suitable for connection to the embodiment of FIG. 1.
Figure 16:
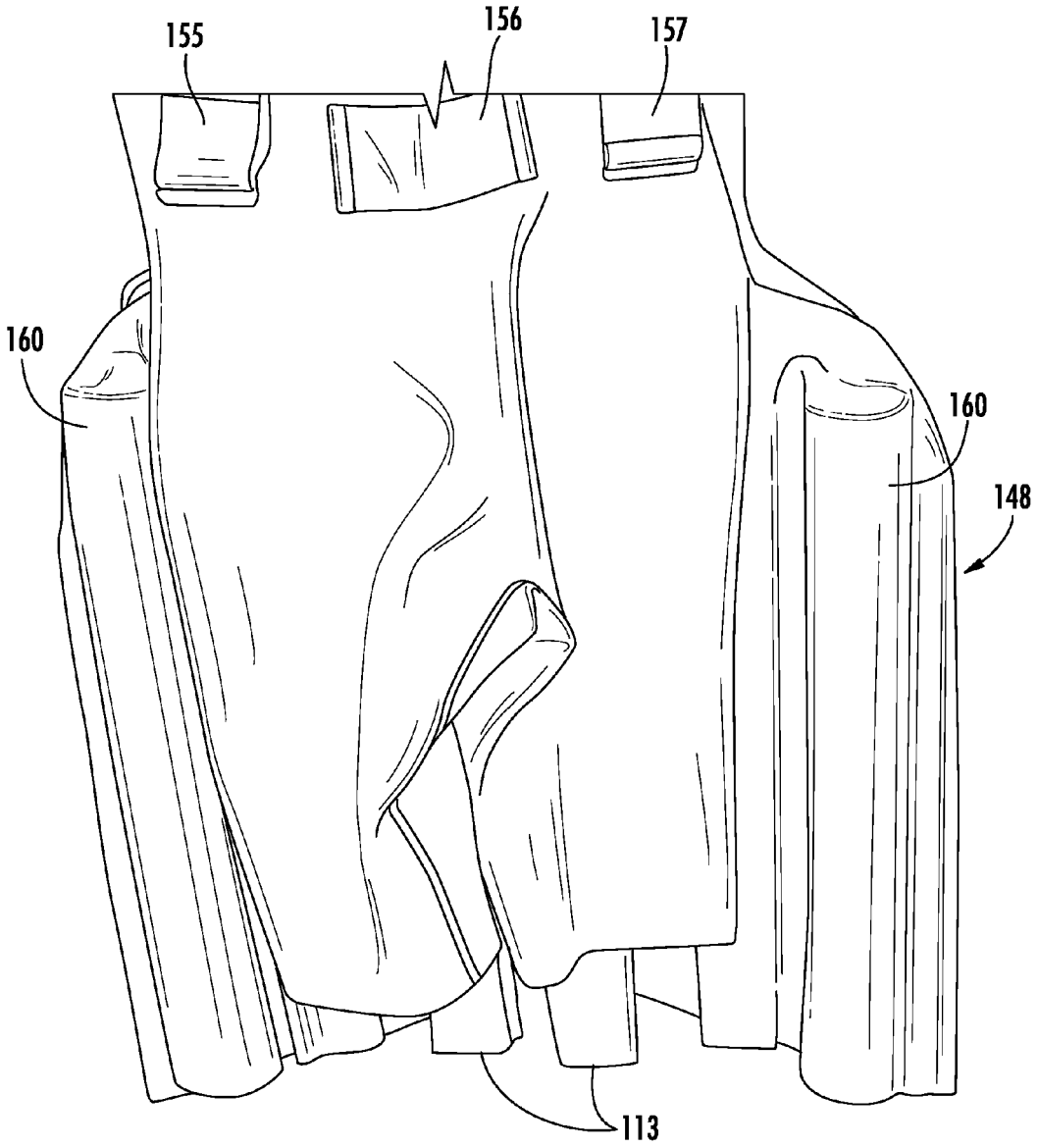
FIG. 16 is a partial rear perspective view of the embodiment of FIG. 14.

With reference initially to FIGS. 1-3, a body surfing hydrofoil 100 may optionally be operable with a wet suit, which preferably is worn and removably connected with the surfing hydrofoil 100. The wet suit is herein described, by way of example, as being provided in three embodiments: shorts 130 (FIGS. 8-9); a full suit 140 (FIGS. 10-12); and a short legged suit ("spring suit") 150 (FIGS. 14-16).

With reference now to FIGS. 1-3, the surfing hydrofoil 100 comprises a breastplate 101 and positioning shoulder portions 109 integrated by incorporating the breastplate 101 and a rear flotation member 110 for upper back stabilization. The surfing hydrofoil 100 further comprises connection elements, including braided straps (112, 114, 115, 116) and cut outs 119(*a*), 119(*b*), 121 and 122. These connection elements are connected to the breastplate 101 and the rear floatation member 110 which are connectible to fixed non-elastic surface fixed elements (e.g. FIGS. 10 and 12, 144) on the wet suit. This allows the surfing hydrofoil 100 to be affixed to a user wearing the wet suit and to provide optimal hydrodynamics when in use.

The breastplate 101 is configured to be positioned with an inner surface 111 parallel with and along the length of the chest and torso of a user. The rear flotation member 110 is positioned on the back of the user, kept in place by the integrated shoulder portions 109 and braided straps (FIG. 11, 141 and 142; FIG. 14, 151, 152) passing through the cutouts 119A, 119B. The lower neoprene material of rear floatation member 110 is attached above the waist to braided straps (112, 114) that are integrated with the internal structure of the hydrofoil 100. The breastplate 101 is constructed of a buoyant and semi-rigid material. The surfing hydrofoil 100 comprises an outwardly planar breastplate 101 to provide optimal hydrodynamics when in use.

As best illustrated in FIG. 1, the breastplate 101 has a trapezoidal shape with a curved lower edge 104. The lower edge 104 is arcuate, meeting the side edges 106 at a flared lower rounded corner 105. The lower rounded corners 105 extend longitudinally beyond the middle portion of the lower edge. These extended, flared out rounded corners 105 provide additional surface area to contact the water outside of the width of the user's body and funnel water away from the user's body. The side edges 106 are substantially linear sloping inward to provide a shorter upper edge 107 than lower edge 104. The upper edge 107 has a substantially central inward curvature 108 as it is closest to a neck of the user when in use. The breastplate 101 has a substantially planar outer surface 103.

The breastplate 101 also comprises cutouts 121 and 122 extending through the upper portions of the breastplate from the inner surface 111 to the outer surface 103 for receiving braided shoulder straps 151, 152 (FIG. 14) from rigid non-elastic fixed elements (FIGS. 10 and 12, 144) on the wet suit to secure the breastplate 101 in place, as will be addressed later with reference to FIG. 14.

The surfing hydrofoil 100 also comprises spacers (FIG. 2, 102; FIG. 3, 102*a*, 102*b*, and 102*c*) constructed from a buoyant material. The spacers are affixed to the inner surface 111 of the breastplate 101 and extend substantially along the length of the inner surface 111. The spacers 102 provide added structure and buoyancy to the breastplate 101 and act as a soft cushion against a user's chest and lungs to assist breathing during a prone or vertical position by providing a compressible material to compress and retract during breathing. The spacers 102 also provide additional height for the surfing hydrofoil 100 to space the user's torso further away from the breastplate 101 and thereby desirably raise the user further above the surface of the water while in use. The spacers 102 are dimensioned to provide approximately four to five inches of distance from the user's chest to the outside surface area where the breastplate 101 contacts the water surface and creates a hydrofoil effect. The distance is not specified as a limitation.

The shoulder portions 109 are comprised of elongated flexible members constructed as foam encased neoprene material and dimensioned to extend from the user's upper chest at the front of the torso, over the shoulders, and to the user's upper shoulders at the back of the torso. The shoulder portions 109 are connected to the breastplate 101 at connection 162. The integrated shoulder portions 109 include the cut outs 119A and 119B in the rear portion 125 of the shoulder portions 109. The cut outs 119A and 119B extend through the shoulder portions 109 from the inner surface to the outer surface of the incorporated shoulder portions 109 to receive the shoulder braided straps (FIG. 11, 141 and 142; FIG. 14, 151 and 152) of the wet suits (FIG. 11, 140; FIG. 14, 150) to removably connect the surfing hydrofoil 100 with the wetsuit (FIG. 11, 140; FIG. 14, 150) and to hold the rear flotation member 110 in place on the user's back. The rear flotation member 110 is preferably attached to the breastplate 101 at only its upper and lower portions to allow freedom of movement by the wearer. The shoulder portions 109 are adjustable and can include, both for buoyancy and for comfort, foam elements 109A positioned within the neoprene to act as a counter balance while in a vertical orientation.

In some cases, and as illustrated with reference now to FIGS. 4-7, it may be desired to provide additional lift with the use of leg wings 38. One embodiment extends down the legs of the user and is preferably curved outwardly to rest against the front of the user's legs. As further described below, spacers 113 separate the wing element 45 from the leg.

The leg wing 38 has a rear sleeve 40 attachable about the user's leg with the use of attachment means such as, but not intended to be limited to, hook-and-loop-type fastener elements or zippers. Affixed to a front of the sleeve 40 is a substantially rigid wing element 45 having a cylindrical flotation element 41 affixed longitudinally thereto along an outer edge 42. The leg wing 38 also has a slot 43 along a top edge 44 for receiving an attachment element, to be discussed below.

The leg wings 38 can be affixed to a belt by means of straps 53 (FIG. 6) extending through the leg wing slot 43.

As illustrated with reference to FIGS. 1 through 3 and 10 through 13, a desirable element of the surfing hydrofoil is the inclusion of a plurality of substantially semi-rigid elements including the braided straps, which include waist straps 112 and 114 and back strap 115, a Velcro® and braided combination belt 116, and the cutouts 119A, 119B, 121 and 122. These connection elements are removably connectible with fixed elements 141, 142, 143, 144, and/or 145, that are attached to or sewn onto rigid elements adhered onto an otherwise flexible wet suit. This wet suit incorporates such portions on the suit that do not stretch. This wet suit is wearable by a user with the non-stretching portions ready to accept the Velcro® and braided flexible belt 116 from the lower area on the surfing hydrofoil 100 to hold the surfing hydrofoil in place on the body of the user and in a secure connection to the wet suit.

Figure 8:
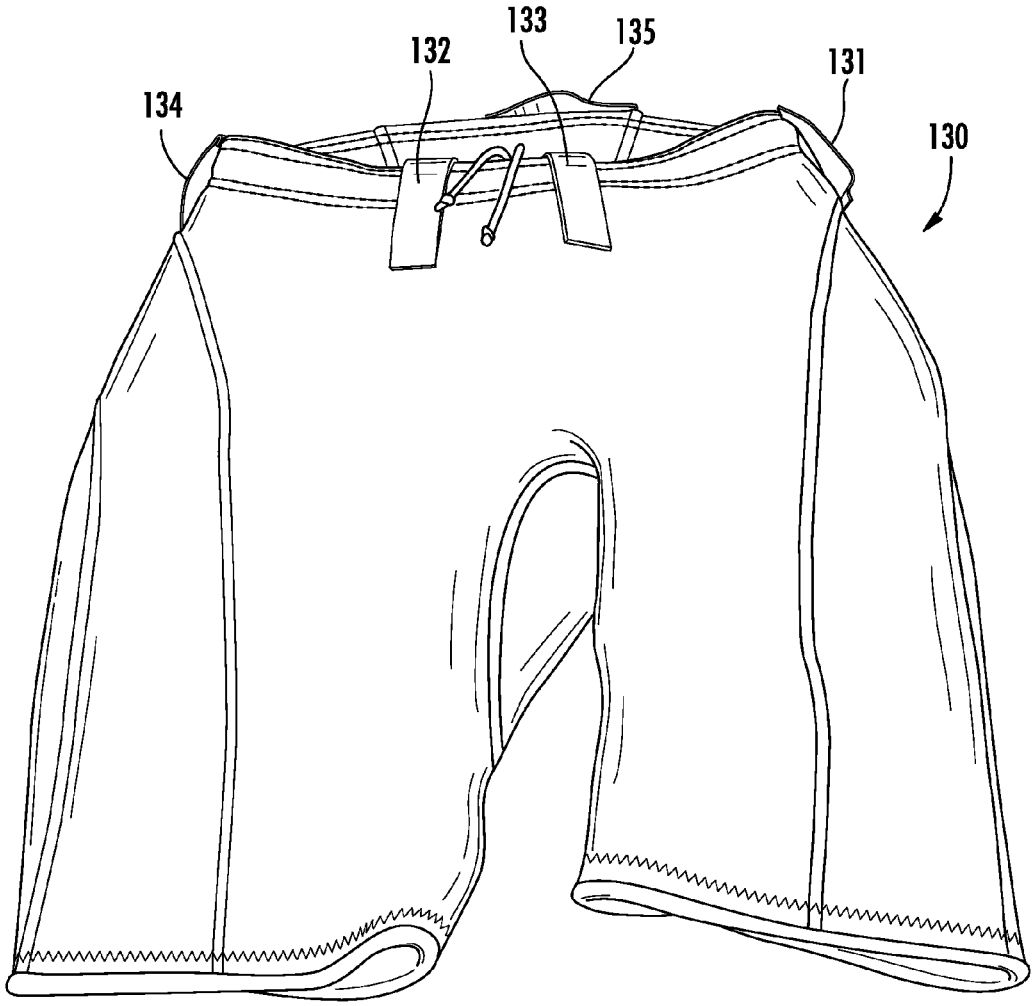
FIG. 8 is a front view of wet suit shorts useable with the embodiment of FIG. 1, herein presented by way of example.
Figure 9:
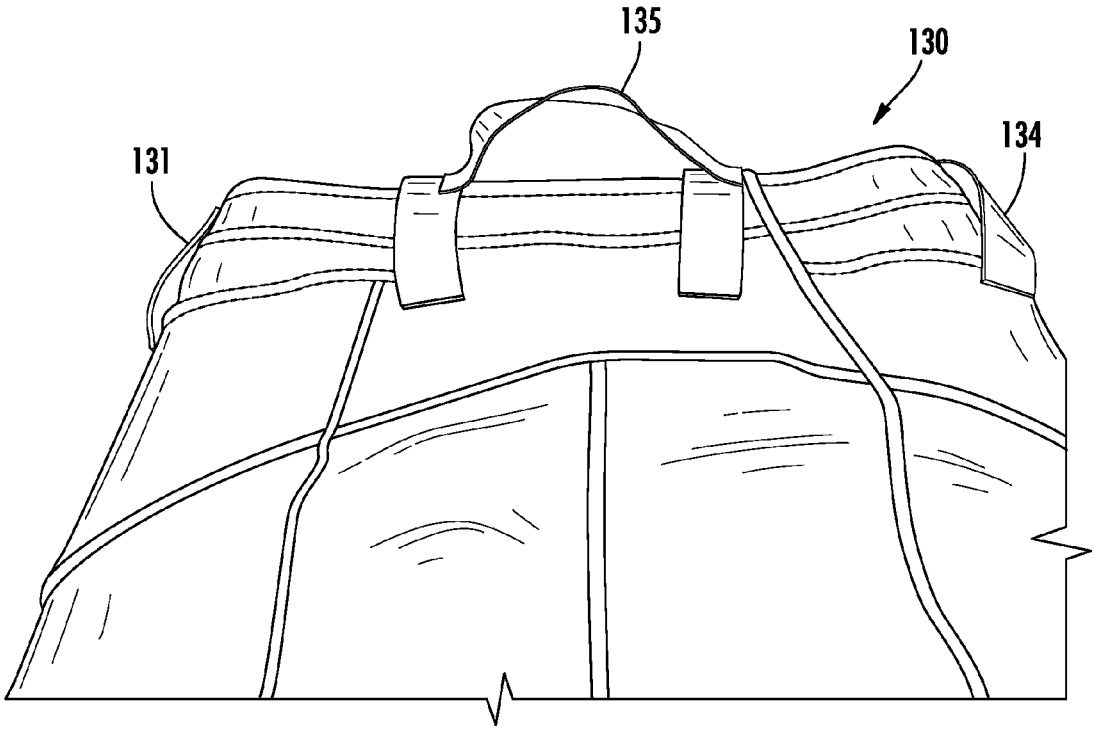
FIG. 9 is a partial rear view of the wet suit shorts of FIG. 8.

As illustrated with reference to FIGS. 3, 8 and 9, the connection elements of the shorts 130 include waist belt loops 131 and 134 on each waist side of the shorts, front belt loops 132 and 133 and a rear loop 135 each of which connect with and are secured to respective waist straps 112 and 114 and back strap 115 on the surfing hydrofoil 100. The waist straps 112 and 114 and back strap 115 are threaded between the surfer's wet suit and belt 116 and then folded over onto itself connection by means of the Velcro® on the straps.

Likewise, the short-legged suit 150, illustrated with reference to FIG. 14, includes connection elements comprising front shoulder straps 151, 152 for connection through the cutouts 121, 122 (FIG. 1) and front waist belt loops 153, 154 and back waist belt loops 155, 156, 157, as illustrated with reference to FIG. 15, for removably connecting with the waist straps 112, 114, 115, 116 (FIG. 3) of the surfing hydrofoil 100 (FIG. 3).

With reference again to FIG. 11, the full suit 140 also includes leg wings 148 that extend down the front of the legs of the suit. The leg wings 148 protrude outwardly to have inner 149B and outer edges 149A that extend wider than the leg and form a planar surface to provide additional surfing surface area. When the leg wings 148 are positioned with inner edges together in use, the leg wings 148 form a unified surface that provides additional surfing area and lift to the legs of the user.

Figure 4:
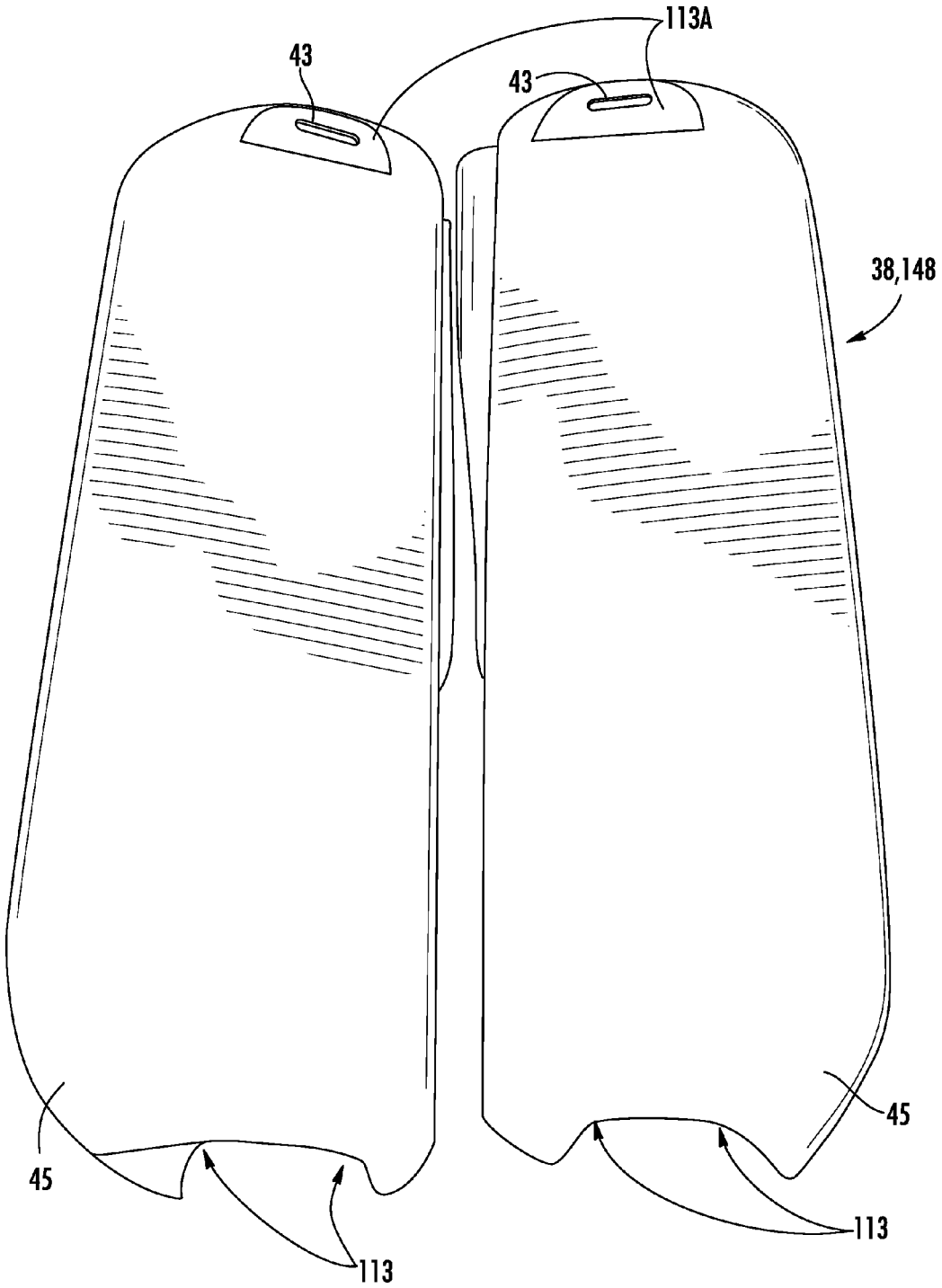
FIGS. 4 and 5 are top front perspective views of leg wings operable with the hydrofoil of FIG. 1.
Figure 5:
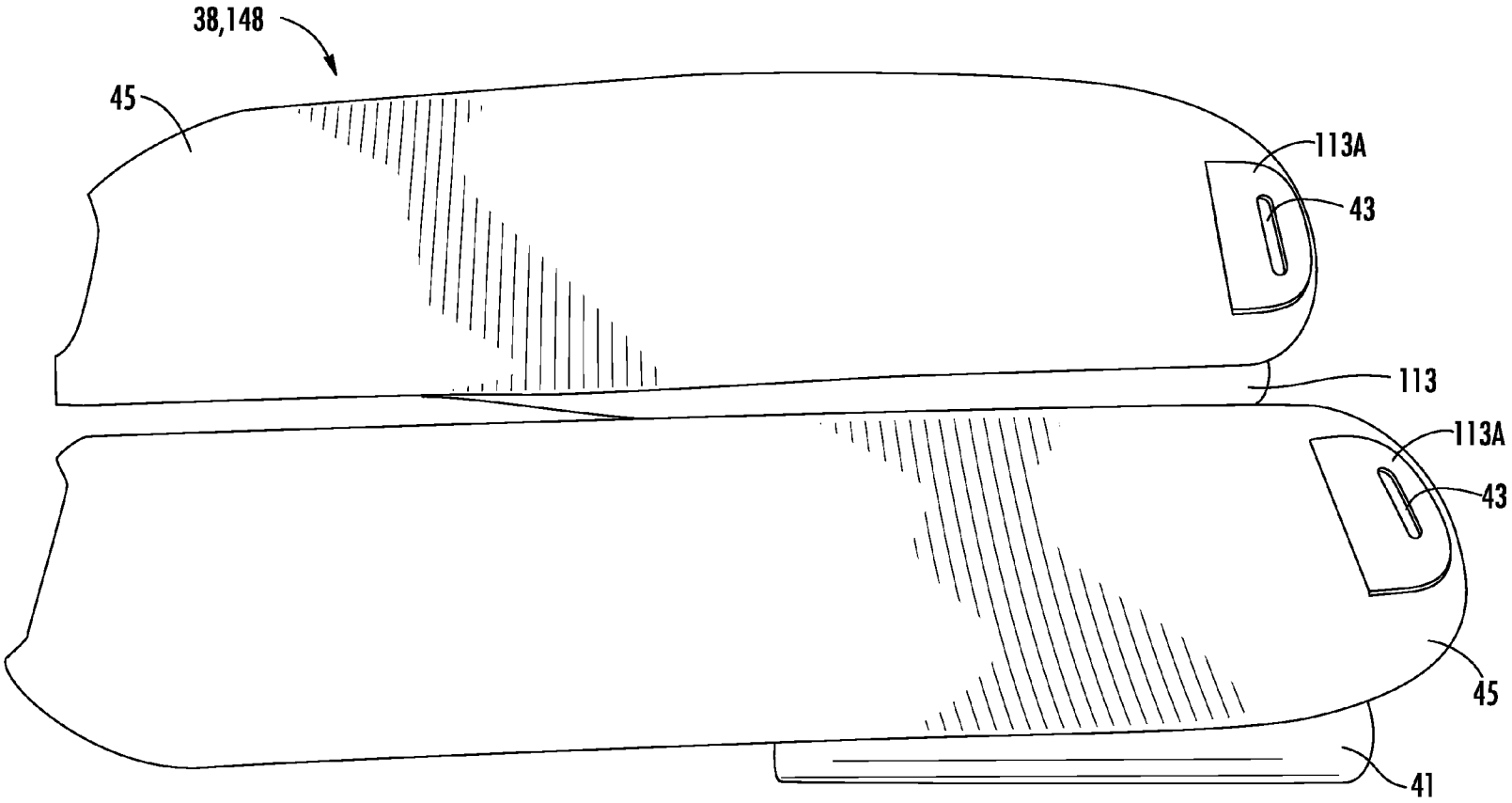
Figure 6:
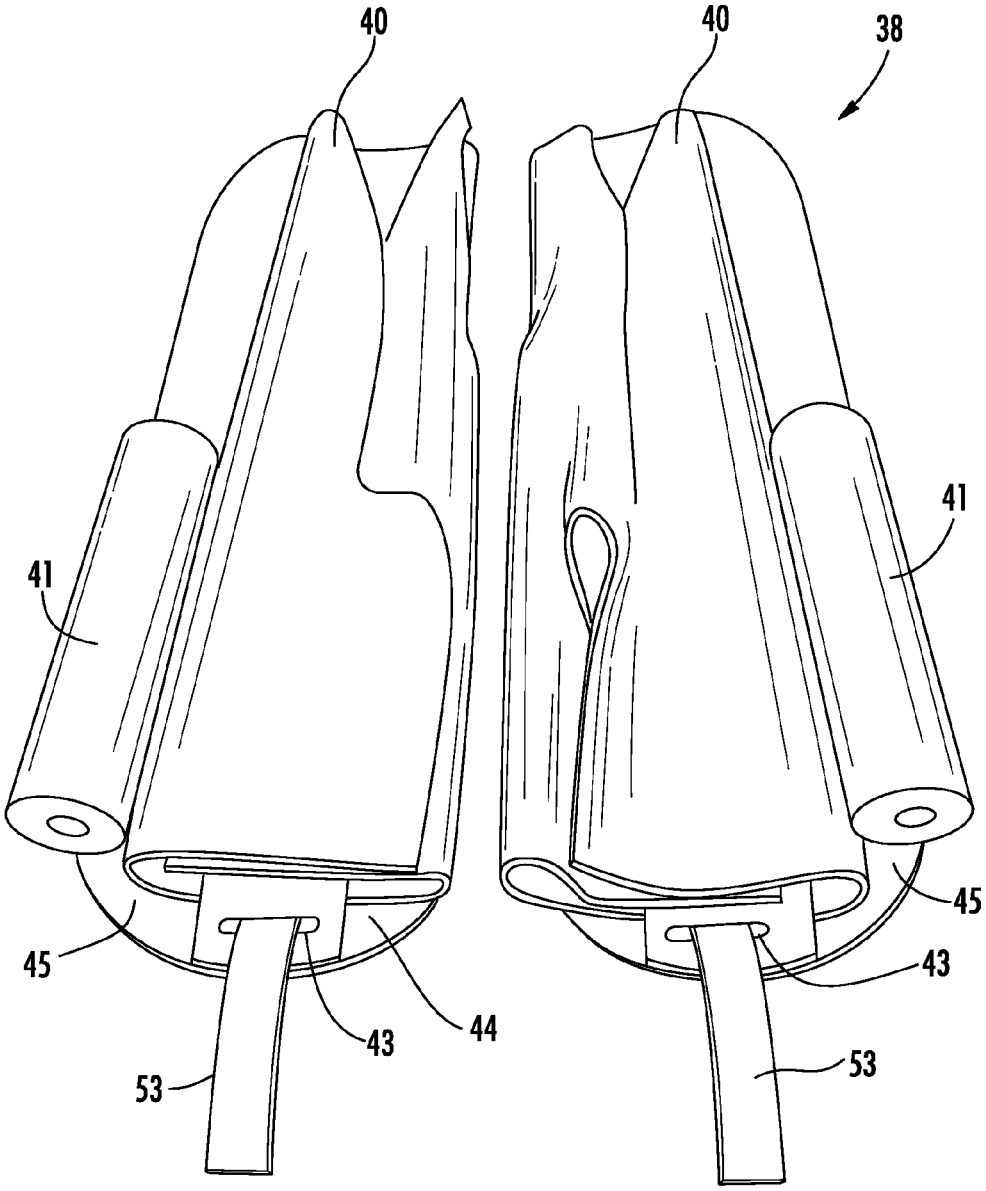
FIG. 6 is bottom perspective view of the leg wings of FIGS. 4 and 5.
Figure 7:
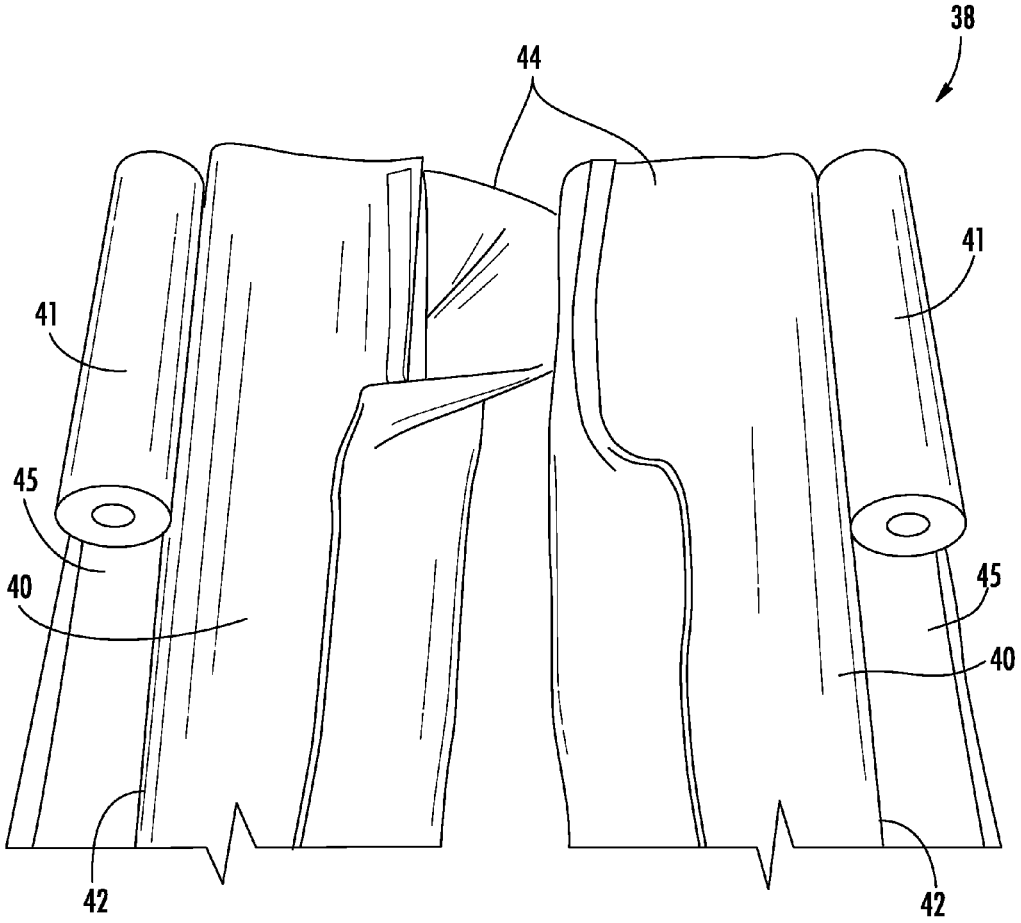
FIG. 7 is a partial bottom perspective view of the leg wings of FIGS. 4 and 5.

As illustrated with reference to FIGS. 14, 16 and again to FIG. 4, the leg wings 148 are also constructed of a buoyant material. The leg wings 148 are securely attached with adhesive and sewn onto the leg wing spacers 113 creating a lower body hydrofoil effect. As a result, cushioning is provided to the user and the leg wings 148 are prevented from being deformed during the wave riding experience. A gap or channel formed by the separation of the leg with the wings is blocked at an upper portion of the leg wings by a seal 113A. The seal 113A prevents water from flowing through the gap. In the spring suit 150, as illustrated with reference to FIG. 14, the leg wings 148 extend only to the knee portion of the user.

With reference to FIGS. 15 and 16, incorporated cylindrical flotation elements 160 (similar to those cylindrical flotation element 41 of FIG. 7) are shown attached to short-legged wet suit 150.

It can be seen by one of skill in the art that the embodiments of the present invention obscure the user's body shape in the water to provide an improved surface for body surfing.

As will be understood, water temperature may determine whether the full suit or the spring suit embodiments are worn. Although water conditions could exist where just the breastplate is needed or just the leg wings used for the body surfing experience.

It will also be understood by one of skill in the art that the neoprene and foam cylinders and spacers as described herein could be replaced with a formed buoyant material, such as an extruded blow-molded foam for more than one element, thereby reducing the plurality of element in favor of a unitary element.

Although the invention has been described relative to various selected embodiments, herein presented by way of example, there are numerous variations and modifications that will be readily apparent to those skilled in the art in light of the above teachings. It is therefore to be understood that, within the scope of the claims hereto attached and supported by this specification, the invention may be practiced other than as specifically described.

What is claimed is:

1. A body surfing hydrofoil comprising:

a breastplate having a buoyant material extending between a first side of an inner surface and an outer surface, the breastplate having a planar shape defined by a perimeter having opposing sides diverging outwardly from a top portion to a bottom portion, wherein the breastplate has a generally rigid construction;

a first spacer affixed to and extending lengthwise along a second side of the inner surface of the breastplate, wherein the first side of the inner surface is opposite the second side;

a second spacer affixed to and extending lengthwise along the second side of the inner surface of the breastplate and spaced apart from and positioned parallel to the first spacer creating an open space therebetween, wherein the first and second spacers are sufficiently flexible for compressing and retracting as a result of breathing by a person biased against the spacers and of sufficient thickness to provide a separation of the person's torso from the water surface when a hydrofoil effect occurs; and a rear flotation member having an integral connection with the breastplate.

2. The body surfing hydrofoil of claim 1, further comprising:

a wet suit formed from a generally flexible fabric;

a plurality of fixed elements secured to an outside surface of the wet suit; and a flexible element attached between pairs of the plurality of fixed elements.

3. The body surfing hydrofoil of claim 2, further comprising:

a shoulder portion that connects the breastplate and the rear flotation member;

wherein the flexible element is operable for securing the shoulder portion to the wet suit by extending through a first cutout in the top portion of the breastplate and through a second cutout in the top portion of the rear flotation member.

4. The body surfing hydrofoil of claim 2, further comprising:

a leg wing carried on a front portion of a leg portion of the wet suit, wherein the leg wing has a planar front surface extending outwardly and beyond the leg portion of the wet suit, and wherein the leg wing includes buoyant material.

5. The body surfing hydrofoil of claim 4, further comprising:

a leg wing spacer affixed between the leg wing and the front portion of the leg portion of the wet suit, wherein the spacer is of sufficient size and shape to create the hydrofoil effect for the person's lower body.

6. The body surfing hydrofoil of claim 1, wherein the spacers comprise foam material.

7. The body surfing hydrofoil of claim 1, wherein the spacers are cylindrical tubes.

8. The body surfing hydrofoil of claim 1, wherein the spacers comprise buoyant material.

9. The body surfing hydrofoil of claim 1, wherein the breastplate has a generally trapezoidal shape.

10. The body surfing hydrofoil of claim 1, wherein the spacers have has a peripheral boundary in spaced relation to the perimeter of the breastplate.

11. The body surfing hydrofoil of claim 1, wherein the top portion of the breastplate includes at least one of a concave edge and a convex edge within central portions thereof.

12. The body surfing hydrofoil of claim 1, wherein the bottom portion of the breastplate includes at least one of a concave and a convex shape within a central portion thereof.

13. The body surfing hydrofoil of claim 1, wherein the integral connection between the rear flotation member and the breastplate comprises a shoulder pad extending from the top portion of the breastplate to a top portion of the rear flotation member.

14. The body surfing hydrofoil of claim 13, wherein the shoulder pad includes a first pad in spaced relation to a second pad, and wherein each pad includes buoyant material.

15. The body surfing hydrofoil of claim 1, further comprising:

a wet suit formed from a generally flexible fabric;

a plurality of belt loops secured to an outside surface of the wet suit; and a plurality of flexible belt straps attached to the bottom portion of the breastplate, wherein the plurality of flexible belt straps are operable for securing a waist portion of the wet suit to the bottom portion of the breastplate.

16. A body surfing hydrofoil comprising:

a wet suit formed from a generally flexible fabric;

a plurality of fixed elements secured to an outside surface of the wet suit;

a breastplate having a buoyant material extending between a first side of an inner surface and an outer surface, the breastplate having a planar shape defined by a perimeter having opposing sides diverging outwardly from a top portion to a bottom portion, wherein the breastplate has a generally rigid construction;

a first spacer affixed to and extending lengthwise along a second side of the inner surface of the breastplate, wherein the first side of the inner surface is opposite the second side;

a second spacer affixed to and extending lengthwise along the second side of the inner surface of the breastplate and spaced apart from and positioned parallel to the first spacer creating an open space therebetween, wherein the first and second spacers are sufficiently flexible for compressing and retracting as a result of breathing by a person biased against the spacer and of sufficient thickness to provide a separation of the person's torso from the water surface when a hydrofoil effect occurs; and a flexible element attached between pairs of the plurality of fixed elements.

17. The body surfing hydrofoil of claim 16, wherein the flexible element comprises a flexible strap extending through a cutout in the breastplate.

18. The body surfing hydrofoil of claim 16, further comprising:

a leg wing carried on a front portion of a leg portion of the wet suit, wherein the leg wing has a planar front surface extending outwardly and beyond the leg portion of the wet suit, and wherein the leg wing includes buoyant material.

19. The body surfing hydrofoil of claim 18, wherein the leg wing is in spaced relation to the leg portion of the wet suit at a distance sufficient for enhancing the hydrofoil effect.

20. The body surfing hydrofoil of claim 18, further comprising:

a leg wing spacer affixed between the leg wing and the front portion of the leg portion of the wet suit, wherein the spacer is of sufficient size and shape to create the hydrofoil effect for the person's lower body.

21. The body surfing hydrofoil of claim 16, wherein the spacers comprise buoyant material.

22. The body surfing hydrofoil of claim 16, wherein the breastplate has a generally trapezoidal shape.

23. The body surfing hydrofoil of claim 16, wherein the spacers have has a peripheral boundary in spaced relation to the perimeter of the breastplate.

24. The body surfing hydrofoil of claim 16, wherein each of the top and bottom portions of the breastplate includes an arcuate edge within central portions thereof.

25. The body surfing hydrofoil of claim 16, further comprising:

a rear flotation member having an integral connection with the breastplate.

26. The body surfing hydrofoil of claim 25, wherein the integral connection between the rear flotation member and the breastplate comprises a shoulder portion extending from the top portion of the breastplate to a top portion of the rear flotation member.

27. The body surfing hydrofoil of claim 26, wherein the shoulder portion comprises a first pad in spaced relation to a second pad, and wherein each of the pads include buoyant material.

* * * * *